United States Patent [19]

Fowler

[11] Patent Number: 4,713,027

[45] Date of Patent: Dec. 15, 1987

[54] RINGED IMPELLER FOR A WATER JET DRIVE

[76] Inventor: Ronald B. Fowler, 1991 Main St., Sarasota, Fla. 33577

[21] Appl. No.: 38,714

[22] Filed: Apr. 15, 1987

[51] Int. Cl.[4] ..... B63H 11/103

[52] U.S. Cl. ..... 440/47; 416/189; 60/221

[58] Field of Search ..... 440/38, 47; 416/177, 416/178, 179, 180, 182, 185, 189, 191; 60/221, 222

[56] References Cited

U.S. PATENT DOCUMENTS

| | | | |
|---|---|---|---|
| 1,518,501 | 12/1924 | Gill | 416/189 R |
| 2,636,467 | 4/1953 | Johnson | 440/38 |
| 3,174,454 | 3/1965 | Kenefick | 440/47 |
| 3,444,817 | 5/1969 | Caldwell | 416/179 |
| 3,805,731 | 4/1974 | Furst et al. | 440/47 |
| 3,826,591 | 7/1974 | Wilson | 416/189 R |
| 4,548,548 | 10/1985 | Gray | 416/189 R |

*Primary Examiner*—Joseph F. Peters, Jr.
*Assistant Examiner*—Stephen P. Avila
*Attorney, Agent, or Firm*—Charles J. Prescott

[57] ABSTRACT

An improved rigid impeller held for driven rotation within the housing of a water jet drive for boats. The impeller includes a hub connectable to the output shaft of a motor, a plurality of impeller blades integrally formed with, and radially extending from, the hub, and an annular ring rigidly connected or integral with and between the outer ends of the impeller. The annular ring has a circular outer surface concentric with the axis of the hub and adapted to closely mate with, and rotate within, a mating circular surface formed in the interior of the housing such that water is efficiently driven through the housing from its inlet in the bottom of the hull of the boat through and discharging from its outlet in the transom of the boat.

7 Claims, 3 Drawing Figures

RINGED IMPELLER FOR A WATER JET DRIVE

BACKGROUND OF THE INVENTION

This invention relates generally to propulsion means for water vessels and more particularly to improvements in the water jet drive system for boats.

The majority of water vessels are driven by a prop shaft-driven propeller external to the hull of the boat. The majority of such systems dispose the propeller beneath the profile of the hull of the boat, thereby increasing the draft of the vessel and/or exposing the rotating propeller rendering it vulnerable to impact with debris, either submerged or at the surface of the water, and the water bottom.

One alternate to the exposed propeller-type system for propelling water vessels is the water jet drive system. This jet drive system includes a rigid impeller mounted for driven rotation within a housing having an inlet and an outlet. The inlet of the housing is disposed in the hull of the boat below the water line for water intake into the housing, while the housing outlet is disposed in the transom of the boat at or above the water line for high velocity discharge from the housing for propelling the boat. A prop shaft interconnects the impeller mounted within the housing to an engine or motor mounted within the boat, usually forward of the housing. By driven rotation, the impeller accelerates the water entering the housing, forcing the water to discharge from the housing outlet at the transom at a relatively high velocity.

One of the obvious benefits of the water jet drive system is that, by its very nature, the boat may be navigated in considerably shallower water than those driven by external propeller(s). This flush mounted profile offered by the jet drive system allows the operator to maneuver the boat over shallow sand bars, reefs, river rapids, beach heads and the like. However, in engaging in such shallow water operation, a considerable amount of abrasive material is likely to be drawn into the water jet drive housing, that abrasive material being held as sediment in the water and/or being drawn up from the water's bottom.

This abrasive material being drawn into the housing of the water jet and forced at very high rates of speed and pressure by, through and around the impeller results in excessive wear in both the impeller and the housing. The close tolerance relationship between the impeller and the housing, which is at the very heart of the performance of any jet drive, is jeopardized as a result of the abrasive action of the rapid forced passage of sediment therethrough.

Critical tolerances are established between the impeller and the housing so as to maximize the performance of the water jet drive system. When this close tolerance relationship is jeopardized by excessive wear, the performance and efficiency of the jet drive system are substantially compromised.

Housing-to-impeller clearance and alignments have been of great concern in this industry in an effort to provide an optimum balance between performance and service life of water jet drive systems. One early jet drive system incorporated an aluminum impeller within an aluminum housing. The close tolerances and alignment were controlled by shimming the axial positioning of the impeller within the housing to achieve clearance tolerances with the range of 0.2 to 0.3 mm. Because of the close tolerance requirements and the softness of the material, excessive wear resulted and usually required costly replacement of both housing and impeller.

One after market response to this wear deterioration dilemma resided in the replacement of the aluminum impellers with those fabricated of stainless steel and to replace the mating surface in the housing with a stainless steel liner. This after-marked "fix" has proved to be quite costly in that the stainless steel impellers are extremely expensive to fabricate and the stainless steel replacement ring within the housing requires the remachining of the worn housing to accept the stainless steel insert.

One manufacturer (Kawasaki) resdesigned the entire impeller-to-housing geometry to incorporate a tapered mating surface between the blade tips of the impeller and the housing which faciliated the axial shimming of the impeller to reachieve close tolerance between the two when wear conditions required same. However, the premature wear situation and reshimming the impeller is a costly and time consuming operation.

Some manufacturers have even resorted to building in excessive clearances to lessen the wear problem and alignment difficulties. However, it appears obvious that these manufacturers are substantially sacrificing performance and efficiency in favor of ease of alignment and extended service life.

The present invention provides an impeller having an annulur ring surrounding and integral or rigidly attached to the ends of the impeller blades. The ring has an outer circular surface which mates within a mating surface in the housing. However, close tolerance relationship between the outer surface of the ring and the housing need not be critical or maintained in order to retain high performance and efficiency of a water jet drive system incorporating the present invention. These results are obtained because any abrasive wear which occurs does so in relation to the inner surface of the ring which surface has virtually no bearing on performance or efficiency of the improved impeller.

SUMMARY OF THE INVENTION

This invention is directed to an improved rigid impeller held for driven rotation within the housing of a water jet drive system for boats. The improved impeller includes a hub connectable to the output shaft of a motor, a plurality of impeller blades integrally formed with, and radially extending from, the hub, and an annular ring rigidly connected or integral with and between the outer ends of the impeller. The annular ring has a circular outer surface concentric with the axis of the hub and adapted to closely mate and rotate within a mating circular surface formed in the interior of the housing such that water is efficiently driven through the housing from its inlet in the bottom of the hull of the boat through and discharging from its outlet in the transom of the boat.

It is therefore an object of this invention to provide a water jet drive system for propelling water vehicles with improved efficiency and reduced wear durability characteristics.

It is another object of this invention to provide an improved impeller for water jet drive systems having an annular ring rigidly connected to the impeller blade tips to eliminate abrasive wear performance degradation of the impeller.

It is another object of this invention to provide an improved water jet drive system for water vessels which maximizes on the clearance tolerances between impeller and housing for enhanced overall efficiency and performance.

It is another object of this invention to provide an improved impeller for water jet drive systems having self-flushing characteristics.

In accordance with these and other objects which will become apparent hereinafter, the instant invention will now be described with reference to the accompanying drawings in which:

DETAILED DESCRIPTION OF THE INVENTION

Figure 1:
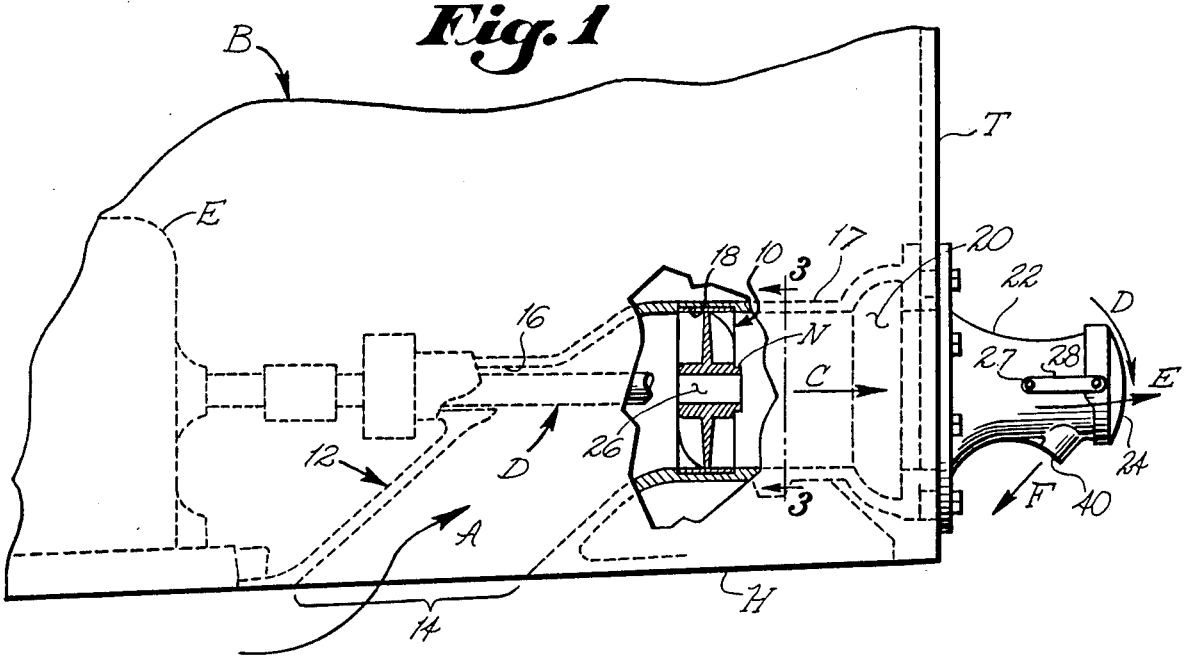
FIG. 1 is a partial side elevation view in broken section of a boat hull with water jet drive system installed therein and having the invention disposed within the jet drive housing.

Referring now to the drawings, and particularly to FIG. 1, a water jet drive system is shown disposed within a boat B. The boat B has a hull H and a transom T between which is mounted jet drive housing 12.

Housing 12 has an inlet 14 disposed through the bottom of the hull H below the water line of the boat B and an outlet 20 disposed adjacent and through the transom T above the water line. The invention 10 is positioned within the housing 12 and there held for rotation on drive shaft D driven by engine E. The housing 12 includes support surface 16 for smooth aligned rotation of the drive shaft D.

In operation, water enters the housing inlet 14 in the direction of arrow A and is forced by impeller 10 in the direction of arrow C out the outlet 20 in transom T. Because water jet drive systems are intended to be axial flow pumps, and because the water flowing through the housing 12 is given a spiral component as it is forced by and through impeller 10, most modern water jet pumps include a stater 17 which is a series of inwardly directed stationary veins (not shown) on the interior surface of the stater 17. The stater thus eliminates a substantial portion of the spiral component or vortex of the flowing water and increases efficiency of the water jet pump.

In order to propel the boat B in a forwardly direction, the water flow discharging in the direction of arrow C out of the housing outlet 20 flows through nozzle 22 attached to the outer surface of the transom T in the direction of arrow E. However, in order to effect maneuverability and reverse operation of the boat B, the discharge nozzle 22 includes reversing cap 24 which is pivotally connected by link 28 to the discharge nozzle 22 at 27. By this means, then, when the discharge cap 24 is rotated to its closed position as shown in the direction of arrow D, the water flow is deflected in the direction of arrow F out of versing aperture 40.

Figure 2:
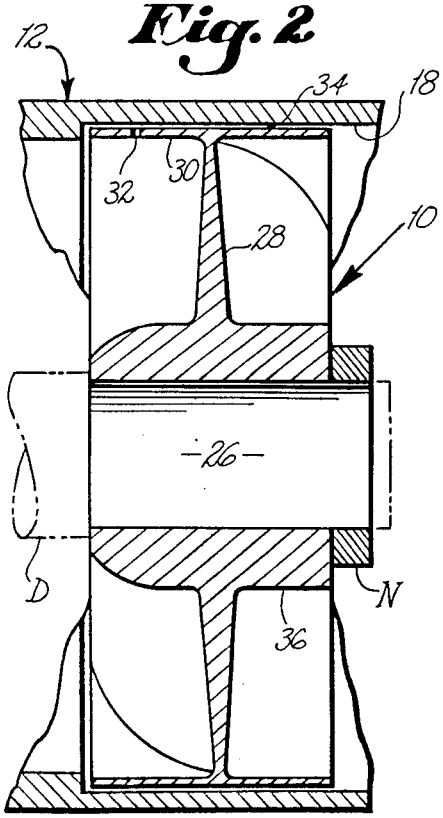
FIG. 2 is an enlarged view of the broken section area of FIG. 1 depicting the invention disposed within the adjacent mating portion of the housing.
Figure 3:
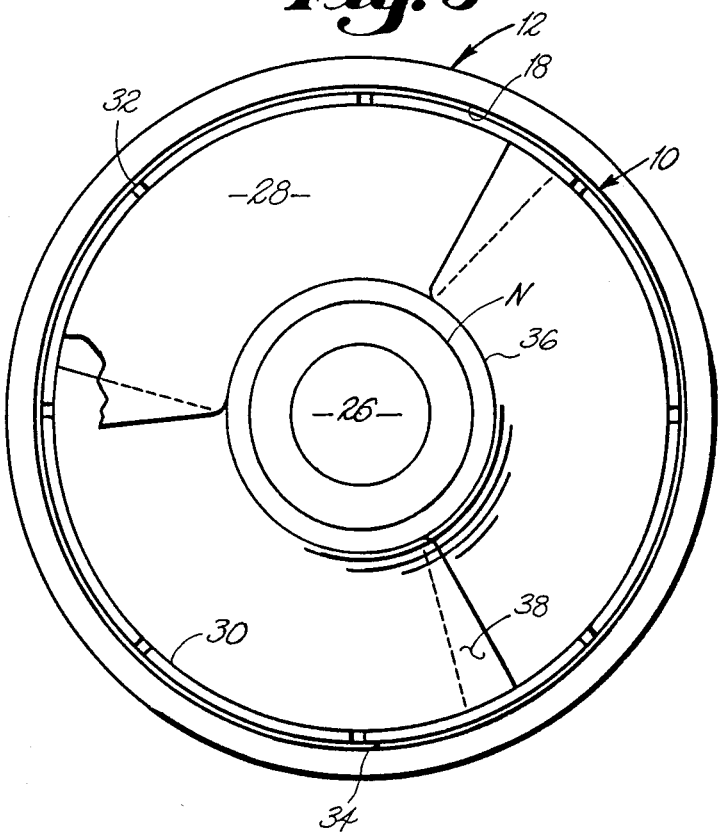
FIG. 3 is an end elevation view of the invention and surrounding housing in the direction of arrows 3—3 in FIG. 1.

Referring now also to FIGS. 2 and 3, the improved impeller 10 includes hub 36 having radially extending blades 28 integral with the hub 36 and integrally connected to surrounding annular shaped circular ring 30. Note that the outer surface of annular ring 30 is concentric with the axis of aperture 26 in hub 36. The housing 12 has formed in its inner surface an inner mating circular surface 18 which is adapted, in conjunction with the annular ring 30, to closely mate together to provide minimal circular gap 34. Thus, virtually all of the water which is passed through the housing 12 and, forced therethrough by impeller blades 28, must pass by blades 28 and through the annular ring 30.

To retain the impeller 10 in place on drive shaft D (shown in phantom), with drive shaft D mating within hub cavity 26, jam nut N is provided to threadably engage over the distal end of the drive shaft D locking the impeller 10 in place as best shown in FIG. 2.

By this novel arrangement, then, because virtually all of the water passing through the water jet drive system must pass within the annular ring 30, any debris or abrasive material which is contained as sediment in the water will only abraid and wear the inner surface of the annular ring 30 causing no detrimental loss in performance. In fact, annular ring 30 may be increased slightly in thickness so as to provide a greater amount of sacrificial material to be removed during this abraiting process without structurally jeopardizing the integrity of the impeller 10.

In the preferred embodiment, as best seen in FIG. 3, the blades 28 overlap one another at area 38 in order to counteract any detrimental effects resulting from high speed rotational centrifugal force tending to tear the annular ring 30 from the ends of blades 28. Where the blades of the impeller 20 do not at least cover 100% of the projected area of the annular ring 30, some centrifugal forces may result in excessively high material stress at the section joining the annular ring 30 to the blades 28 unless other areas of the section are increased to accomodate such centrifugal force stresses. Again, in the preferred embodiment, the overlap of the impeller blades 28 at 38 is preferred and is at about 105% of the projected area within the annular ring.

Despite the smallness of the circular gap 34 between the housing 12 and the annular ring 30, some debris will enter therein. In order to effect flushing of any debris which might deposit or pass therethough, apertures 32 are provided through the annular ring 30 at predetermined spaces around the circumference of the annular ring 30 as shown. These flushing apertures 32 are intended to allow a small amount of water to pass into the circular gap 34 to continually rinse that small area free of debris. It should be noted that, to the extent abrasive action occurs there, virtually no performance loss results. This is so because the performance of this improved impeller 10 is achieved primarily by the annular ring 30 itself which contains virtually all of the water passing through the water jet drive system.

Although the shape of the preferred embodiment of the annular ring 30 is shown to have a cylindrical shape on its exterior surface, it should be noted that this outer surface and mating housing surface 18 may also be tapered or steped and still be within the scope of this invention. Such tapered or irregular surfaces may be otherwise required to accommodate other physical characteristics of both the performance of the jet drive system and structure of the housing 12. Nonetheless, these irregular mating surfaces between housing surface 18 and the outer surface of annular ring 30 lend themselves fully and efficiently to the benefits of this invention.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. In a water jet drive for a boat having a bottom, a transom, and a motor for providing rotational output through an output shaft, the water jet driven having a housing with a water inlet and a water outlet, the inlet disposed through the boat bottom allowing water to flow into the housing, said outlet disposed through the boat transom allowing water to be pumped out of the housing to propel the boat, a rigid motor driven impeller having blades and mounted on the rotatable output shaft, the impeller positioned within the housing to forcably urge and accelerate water entering the housing inlet out through the housing outlet for propelling the boat, the improvement comprising:

an annular ring connected to and between the distal ends of the impeller blades;

said ring having a generally circular outer surface concentric with the output shaft and fitted in close proximity within a mating circular surface in the housing; and a plurality of apertures through said annular ring for flushing debris from between said annular ring and the mating surface in the housing.

2. A water jet drive as set forth in claim 1, wherein:

said impeller blades cover substantially the entire projected area within said annular ring.

3. A water jet drive as set forth in claim 2, wherein:

said impeller blades overlap one another.

4. An integrally formed rigid impeller for a water jet drive used to propel a boat having a bottom, a transom, and a motor for providing rotational output through an output shaft, said impeller driven in rotation by the motor within a housing having an inlet in the boat bottom below the boat water line and an outlet discharging from the boat transom above the boat water line, said impeller comprising:

a hub adapted to be operably connected for rotation and axial thrust to the output shaft of the motor;

a plurality of impeller blades connected to and radially extending from said hub;

said impeller blades adapted to forcably accelerate and convey water through the housing the discharging from the housing outlet;

an annular ring connected around and between the distal ends of said blades;

said ring having a circular outer surface concentric with said hub axis and the output shaft and adapted to fit and rotate in close proximity to a mating circular surface formed in the interior of the housing; and a plurality of apertures through said annular ring for flushing debris from between said annular ring and the mating surface in the housing.

5. An impeller as set forth in claim 4, wherein:

said impeller blades cover substantially the entire projected area within said annular ring.

6. An impeller as set forth in claim 5, wherein:

said impeller blades overlap one another.

7. An integrally formed rigid impeller for a water jet drive used ot propel a boat having a bottom, a transom, and a motor for providing rotational output through an output shaft, said impeller driven in rotation by the motor within a housing having an inlet in the boat bottom below the boat water line and an outlet discharging from the boat transom above the boat water line, said impeller comprising:

a hub adapted to be operably connected for rotation and axial thrust to the output shaft of the motor;

a plurality of impeller blades connected to and radially extending from said hub;

said impeller blades adapted to forcably accelerate and convey water through the housing and discharging from the housing outlet;

an annular ring connected around and between the distal ends of said blades;

said ring having a circular outer surface concentric with said hub axis and the output shaft and adapted to fit and rotate in close proximity to a mating circular surface formed in the interior of the housing; and a plurality of apertures through said annular ring for flushing debris from between said annular ring and the mating surface in the housing;

said impeller blades covering substantially the entire projected area within said annular ring and overlap one another.

* * * * *